US010252845B2

(12) United States Patent
Rognard et al.

(10) Patent No.: US 10,252,845 B2
(45) Date of Patent: Apr. 9, 2019

(54) TAMPER-EVIDENT CLOSURE

(71) Applicant: OBRIST CLOSURES SWITZERLAND GMBH, Reinach (CH)

(72) Inventors: Jean-Yves Rognard, Marcy-sur-Anse (FR); Derek John Hindle, Saint Cloud (FR); Philippe Bardet, Gleize (FR)

(73) Assignee: OBRIST CLOSURES SWITZERLAND GMBH, Reinach (CH)

( * ) Notice: Subject to any disclaimer, the term of this patent is extended or adjusted under 35 U.S.C. 154(b) by 0 days.

(21) Appl. No.: 15/118,067

(22) PCT Filed: Feb. 7, 2015

(86) PCT No.: PCT/EP2015/052566
§ 371 (c)(1),
(2) Date: Aug. 10, 2016

(87) PCT Pub. No.: WO2015/121177
PCT Pub. Date: Aug. 20, 2015

(65) Prior Publication Data

US 2017/0240326 A1 Aug. 24, 2017

(30) Foreign Application Priority Data

Feb. 13, 2014 (GB) ..... 1402552.2
Mar. 7, 2014 (GB) ..... 1404048.9

(51) Int. Cl.
*B65D 1/02* (2006.01)
*B65D 41/34* (2006.01)
(Continued)

(52) U.S. Cl.
CPC ..... *B65D 55/024* (2013.01); *B65D 1/0246* (2013.01); *B65D 41/34* (2013.01);
(Continued)

(58) Field of Classification Search
CPC ..... B65D 55/024; B65D 1/0246; B65D 2102/003
(Continued)

(56) References Cited

U.S. PATENT DOCUMENTS 3,774,795 A 11/1973 Leenaards
4,795,044 A 1/1989 Beck
(Continued)

FOREIGN PATENT DOCUMENTS

CN 2379425 Y 5/2000
CN 1468189 A 1/2004
(Continued)

OTHER PUBLICATIONS

International Search Report, dated May 28, 2015, issued in International Patent Application No. PCT/EP2015/052566, filed Feb. 7, 2015.
(Continued)

*Primary Examiner* — Jeremy Carroll
(74) *Attorney, Agent, or Firm* — Wiley Rein LLP

(57) ABSTRACT

A flip-top dispensing closure (10) is provided. The closure comprises: a base (12) connectable to a container neck (1); a lid (14) hingedly connected to the base so as to be movable between a closed position and an open position; and a dispensing member (20). The closure further comprises a tamper-indicating member (5). The tamper-indicating member (5) activates either: upon first opening of the lid (14); or if the base (12) is removed from the neck (1).

15 Claims, 11 Drawing Sheets

(51) Int. Cl.
*B65D 47/08* (2006.01)
*B65D 55/02* (2006.01)

(52) U.S. Cl.
CPC ..... *B65D 47/0804* (2013.01); *B65D 47/0809* (2013.01); *B65D 2101/0023* (2013.01); *B65D 2101/0069* (2013.01)

(58) Field of Classification Search
USPC ..... 222/153.06; 215/235
See application file for complete search history.

(56) References Cited

U.S. PATENT DOCUMENTS

| | | | | |
|---|---|---|---|---|
| 5,090,583 | A | 2/1992 | Hoffman | |
| 5,888,598 | A | 3/1999 | Brewster et al. | |
| 6,039,198 | A | 3/2000 | Wolfe et al. | |
| 6,550,626 | B1 * | 4/2003 | Randall | B65D 41/3442 215/253 |
| 2006/0032873 | A1 | 2/2006 | Gerondale et al. | |
| 2007/0205175 | A1 | 9/2007 | Darr et al. | |
| 2007/0210026 | A1 | 9/2007 | Darr et al. | |
| 2008/0124432 | A1 * | 5/2008 | Ma | B65D 41/3428 426/115 |
| 2009/0152269 | A1 * | 6/2009 | Pucci | B65D 47/0823 220/254.3 |
| 2012/0067922 | A1 | 3/2012 | Benoit-Gonin | |

FOREIGN PATENT DOCUMENTS

| | | | |
|---|---|---|---|
| CN | 103402884 | A | 11/2013 |
| EP | 2314512 | A1 | 4/2011 |
| WO | 98/29314 | A1 | 7/1998 |
| WO | 00/76875 | A1 | 12/2000 |
| WO | 2013/092529 | A1 | 6/2013 |
| WO | 2013/129940 | A1 | 9/2013 |

OTHER PUBLICATIONS

Search Report, dated Mar. 25, 2014, issued in related GB Patent Application No. GB1402552.2, filed Feb. 13, 2014.
Search Report, dated Nov. 24, 2014, issued in related GB Patent Application No. GB1404048.9, filed Mar. 7, 2014.
Office Action, dated Mar. 20, 2017, issued in related Chinese Patent Application No. 201580007133.4, filed Feb. 7, 2015.
Second Office Action dated Apr. 20, 2018 in related Chinese Patent Application No. 201610737809.1, filed Feb. 7, 2015 (with English translation).
First Office Action dated Jul. 31, 2017 in related Chinese Application No. 201610737809.1, filed Feb. 5, 2015.
Communication Pursuant to Article 94(3) EPC dated Feb. 19, 2018 in European Application No. 15706173.0, filed Feb. 7, 2015.

* cited by examiner

TAMPER-EVIDENT CLOSURE

RELATED APPLICATIONS

This application is a § 371 National Stage Application of PCT/EP2015/052566, filed Feb. 7, 2015, and claims priority benefit of Applications No. GB 1402552.2, filed Feb. 13, 2014, and No. GB 1404048.9, filed Mar. 7, 2014, each of which are incorporated entirely herein by reference for all purposes.

FIELD

The present invention relates generally to a closure and particularly, although not exclusively, to a container closure including one or more tamper-indicating features.

BACKGROUND

There is a widespread requirement within the field of closures for mechanisms which can be used to indicate to a consumer if a closure is unopened. One very common system uses a drop band which is frangibly connected to the open end of a closure base and which drops onto and remains on a container neck if the closure base is removed. There are also mechanisms for indicating if two parts of a closure have been separated, for example, if a lid has been removed from a base.

SUMMARY

The present invention seeks to provide improvements over known tamper-indicating closures.

According to an aspect of the present invention there is provided a flip-top dispensing closure comprising: a base connectable to a container neck; a lid hingedly connected to the base so as to be movable between a closed position and an open position; and a dispensing member, the closure further comprising a tamper-indicating member, in which the tamper-indicating member activates either: upon first opening of the lid; or if the base is removed from the neck.

If the base is removed from the neck the dispensing member may be retained on the neck until after the tamper-indicating member is activated, and thereafter is removed together with the base.

The dispensing member may include a bead or the like for interacting with a corresponding bead or the like on the tamper-indicating member, the beads interacting to cause activation of the member if the lid is opened or if the base is removed.

The dispensing member may have a bead or the like for retaining it on the container neck.

The base may include a bead for engaging the dispensing member so as to lift the dispensing member off the neck if the base is removed.

The base bead may be located axially spaced from the dispensing member so that as the base initially moves axially off the neck the dispensing member remains on the neck, whereby to cause the tamper-evident member to activate.

According to a further aspect of the present invention there is provide a flip-top dispensing closure comprising a base connectable to a container neck, and a lid hingedly connected to the base so as to be movable between a closed position and an open position, the closure comprises a bi-functional tamper-indicating member which breaks either upon first opening of the lid or if the base is removed from the neck.

The present invention therefore provides a unitary tamper-indicating system capable of providing multiple functions.

The closure may comprise a dispensing member, for example a spout. The dispensing member may be separate from the base and lid.

In some embodiments the dispensing member may cause the tamper-evident member to break if the base is removed from the neck.

The dispensing member may be lifted off the container neck if the base is removed. The lifting may be delayed/retarded so as to cause activation of the tamper-evident member.

The member may comprise a double ring structure with two rings frangibly connected together that break apart in a tamper-indicating event.

When the tamper-indicating member is activated at least part of the member may fall into a pocket or void in the base. In some embodiments part of the member is visible in a gap prior to opening and moves out of the gap as a result of an opening event.

According to a further aspect there is provided a container closure comprising a base and a lid, the base is attachable to a container and the lid is attachable to the base, the closure has a tamper-evident member which is capable of indicating if the lid has been opened, in which the said tamper-evident member is also capable of indicating if the base is removed from the neck.

According to a further aspect there is provided a container closure comprising two or more parts and being connectable to a container, the closure being vulnerable to two or more different opening events, in which the closure includes a single, multi-functional tamper-indicating system activatable if any of the opening events occur.

In one embodiment there are important interactions between:

(1) a bead on a spout and a bead on a lower part of a tamper-evident double ring, which causes the ring to break if the lid is opened or if the base is removed;
(2) a bead/clip on a spout which holds it onto a container neck (until a bead on the base lifts it off); and
(3) a bead on the base and part (e.g. an edge) of the spout, which cause the spout to be lifted off the neck after the tamper-evident ring has been broken due to interaction (1).

In some embodiments the member is the only tamper-indicating feature; in other embodiments further features may be provided.

Closures of the present invention may be formed from any suitable material, such as a plastics material (for example PP or PE). The closure may be formed by molding, for example by injection or compression molding. Closures with lids and bases may be formed with the lid in an open or closed position.

The present invention also provides a closure as described herein in combination with a container.

A further aspect provides a method of providing a container closure with multi tamper-evidencing functionality using only a single tamper-evident break event which occurs upon any of two or more different opening events.

A further aspect provides a neck or neck finish for a container, the finish having a height in the range 7 mm to 11 mm when measured from a transfer bead. The finish may have a height in the range 8 to 10 mm, for example in the range 8 mm to 9 mm. In some embodiments the finish has a height of approximately 8.41 mm.

A further aspect provides a neck or neck finish for a tamper-evident closure, the neck finish being formed with an absence of a tamper-evident bead. The neck finish may be formed in combination with a closure having a base and be part of a system that can still detect an attempt to remove the base and provide an indication that the base has been removed. The finish of aspects and embodiments of the present invention may be a 29/25 finish.

Finishes of the present invention may include engagement means for enabling connection to a closure, for example they may include an external and/or internal screw thread formation, snap bead or the like.

A further aspect provides a container having a neck or neck finish as described herein.

The present invention also provides for a closure as described herein in combination with a neck, neck finish or container as described herein.

The container, neck or neck finish of the present invention may be formed from any suitable material, including plastics material (e.g., PET, PP or PE) or glass.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims.

BRIEF DESCRIPTION OF THE DRAWINGS

The present invention will now be more particularly described, by way of example, with reference to the accompanying drawings, in which:

FIG. 18 and FIG. 19 show the closure after the base has been screwed back on.

DETAILED DESCRIPTION

Figure 1:
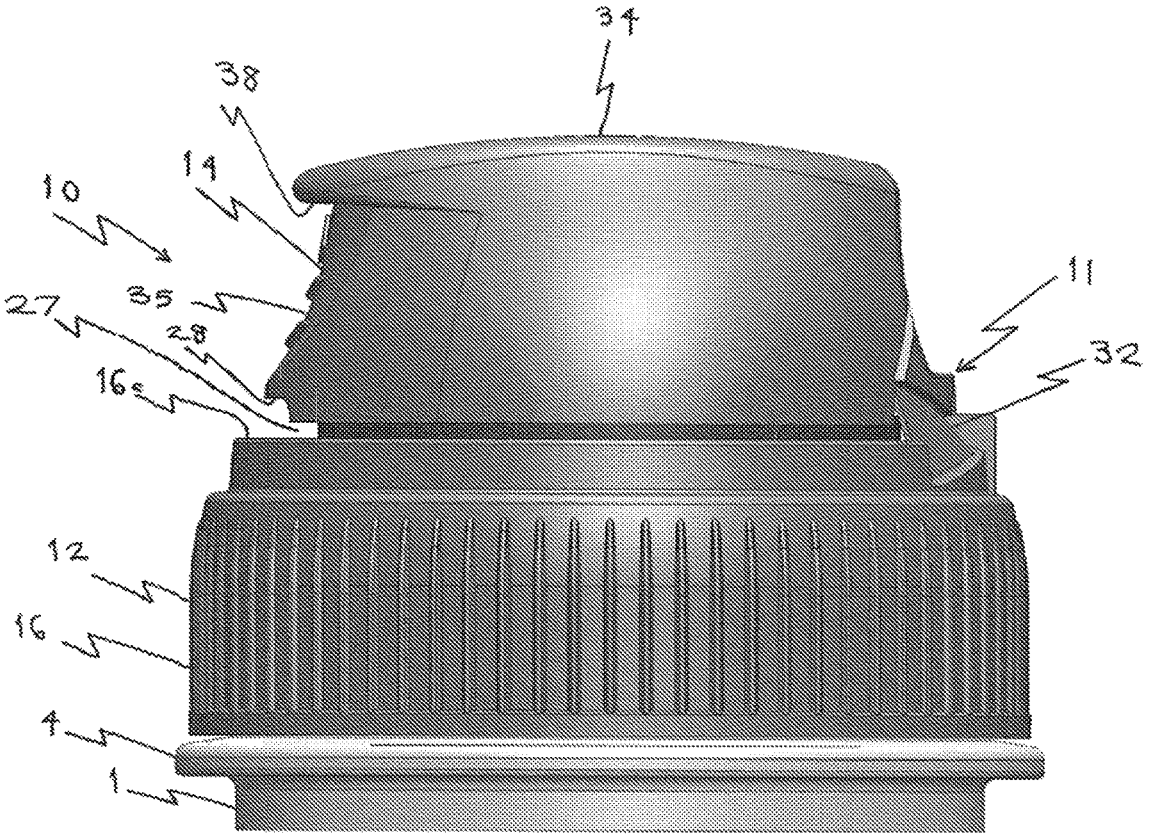
FIG. 1 is a side view of a closure formed according to the present invention and shown in an unopened position.
Figure 2:
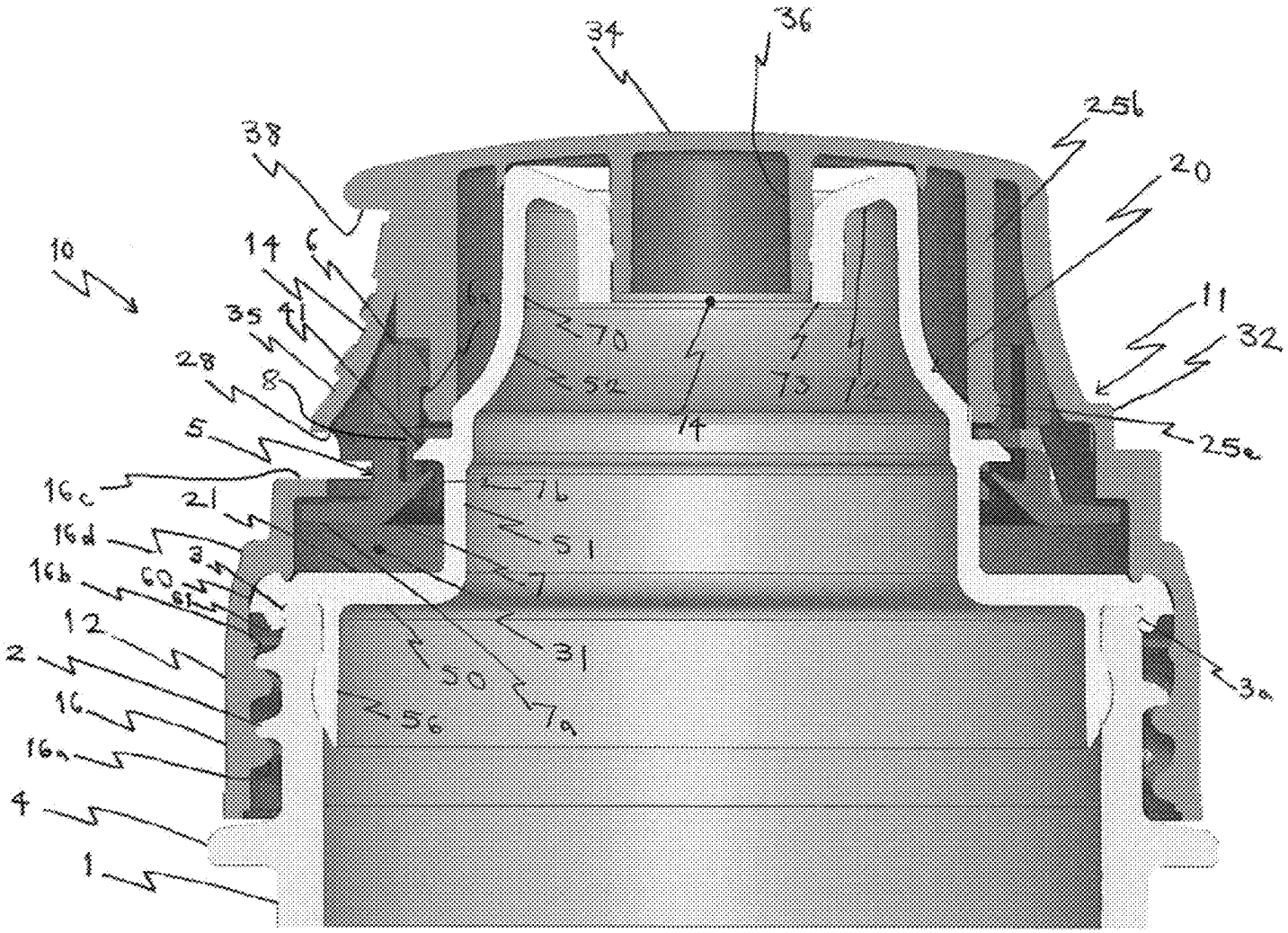
FIG. 2 is a section of the closure of FIG. 1.
Figure 3:
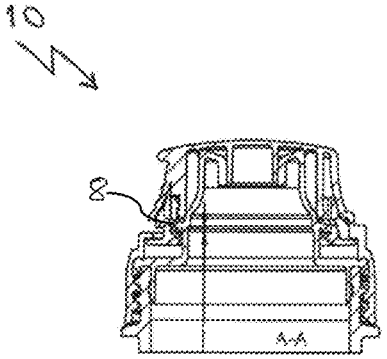
FIG. 3 and FIG. 4 are further sectional and side views of the closure of FIG. 1 and FIG. 2.
Figure 4:
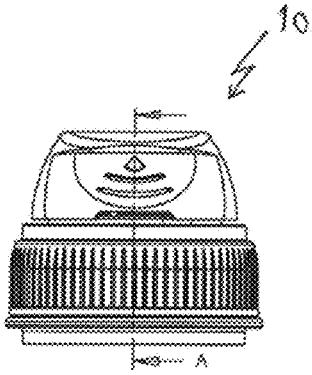

Referring first to FIG. 1 and FIG. 2 there is shown a sportscap closure generally indicated 10.

The closure 10 comprises a body 11, a spout 20 and a tamper-evident member 5.

The closure 10 is connectable to a container neck 1.

The body 11 comprises a base 12 and a lid 14.

The base 12 comprises a generally cylindrical side wall 16. The side wall 16 terminates at one end with an annular shoulder 16*c* which extends radially inwards.

The interior of the base side wall 16 comprises internal screw thread formations 16*a* for engaging corresponding external screw thread formations 2 on the container neck located above a transfer bead 4. The interior of the side wall 16 further comprises an annular retention bead 16*b* positioned below a second shoulder 16*d* in the sidewall 16.

The lid 14 comprises a top plate 34 from which depends a curved outer sidewall 35; an inner skirt 25*b* depends from the underside of the top plate, radially inwards of the outer wall 35 and a spigot 36 depends from the underside of the center of the plate 34, radially inwards of the inner skirt 25*b*.

Furthermore, the skirt 25*d* of the lid 25 has a projection 25*e*. This projection 25*e* projects radially outwards at the lower end of the skirt 25*d*.

The generally turret-like lid 14 is connected to the free end of the shoulder 16*c* via a hinge arrangement generally indicated 32.

A gap 27 is left between the lower end of the side skirt and the upper surface of the base 12 and the lid includes a shallow cut-out window 28 opposite the hinge 32.

Opposite the hinge 32 the lid 14 includes a small peak 38 used to lift the lid and flip it open with respect to the base 12.

The spout 20 comprises a lower portion 50, a central portion 51 and an upper portion 52.

The lower portion 50 comprises a ledge 21 with an annular seal 56 depending therefrom. In use, the seal 56 enters the bore of the container neck such that it seals against its inner surface.

The ledge 21 comprises a plurality of radially outwardly extending retention spokes 60 at is periphery. The spokes 60 abut against the shoulder 16*d*. It will be noted that the spokes 60 are spaced from the bead 16*b* and that they terminate with a "claw" 61 that allows them to grip onto the rim 3 of the container neck 1 which comprises a peripheral bead 3*a*.

The central section 51 includes a flange 41 which projects radially outward from the side of the spout 40 at approximately the same axial level, when assembled with the base and/or lid, as the gap 27 between the underside of the lid 25 and the upper surface of the base 12.

A void or pocket 31 is provided between the spout ledge 41 and the base 12.

The upper portion 52 comprises a curved, generally frustoconical outer surface defining a spout. At the end of the spout side wall opposite the central portion 51 is a cylindrical terminal portion 70. An inclined annular orifice wall 72 extends inwards from the free end of the portion 70 and from it an annular wall 73 depends; the wall 73 defines an orifice 74. In the closed position the lid spigot 36 enters through the wall 73 to close the orifice 74.

The tamper-evident member 5 takes the form of a separate element having an upper ring 6 and a lower ring 7 connected together by frangible connections 8. The tamper-evident member 5 fits between the base and the lid and radially outward of the spout 20. The upper ring 6 includes an upper projection 6*a* which projects radially inwardly. The lower ring includes a flange 7*a* which projects radially outwardly, and a hook-like inner projection 7*b* which projects radially inwardly.

The upper projection 6*a* engages with the projection 25*e* provided on the radially inner surface of the inner skirt 25*b* of the lid.

The flange 7*a* sits adjacent (and may or may not initially engage with) the underside of the shoulder 16*c* and the projection/bead 7*b* sits adjacent (and may or may not initially engage with) under the spout flange 41.

As described below the lid cannot be opened without breaking the frangible connections 8 and separating the rings 6, 7.

Figure 5:
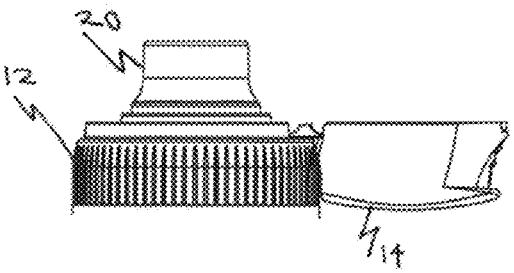
FIG. 5 to FIG. 7 show side, perspective and sectional views of the closures of FIG. 3 and FIG. 4 following a first type of premier opening event in which a lid is opened.
Figure 6:
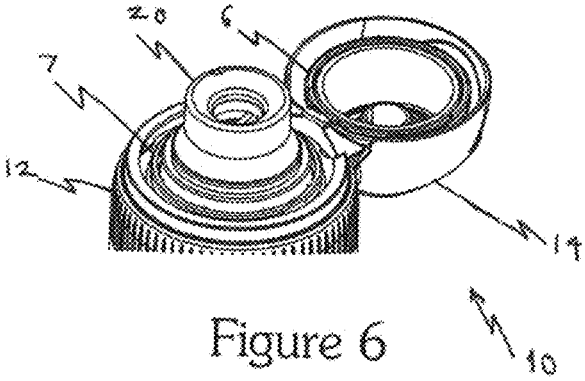
Figure 7:
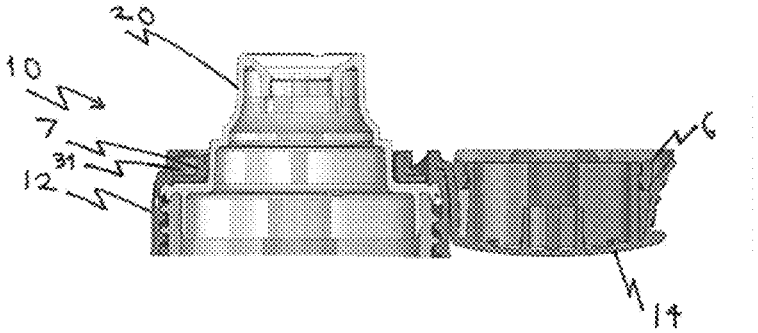

When a user desires to drink from the spout they grasp the lid and flip it open to the position shown in FIG. 5 to FIG. 7 using the peak 38.

Due to the interaction between the member 5 and the base and spout the member 5 splits into the two rings 6, 7 as shown in FIG. 5 to FIG. 7; and the lower ring 7 is no longer visible through the gap 27, having dropped into the void 31 above the spout ledge 21.

The user can now access the spout freely and unencumbered by the lid. With the lid in the open position the ring 6 is retained in the lid by the projection 25*e* and is clearly visible in the lid. The ring 7 drops into and is retained in the void. The separated rings 6, 7 show that the closure lid has been opened at least once.

Referring now to FIG. 8 to FIG. 17, in addition to the lid opening being the premier opening event, the closure 10 is also capable of showing that the base has been removed (or an attempt has been made to remove the base) from the neck 1.

Figure 8:
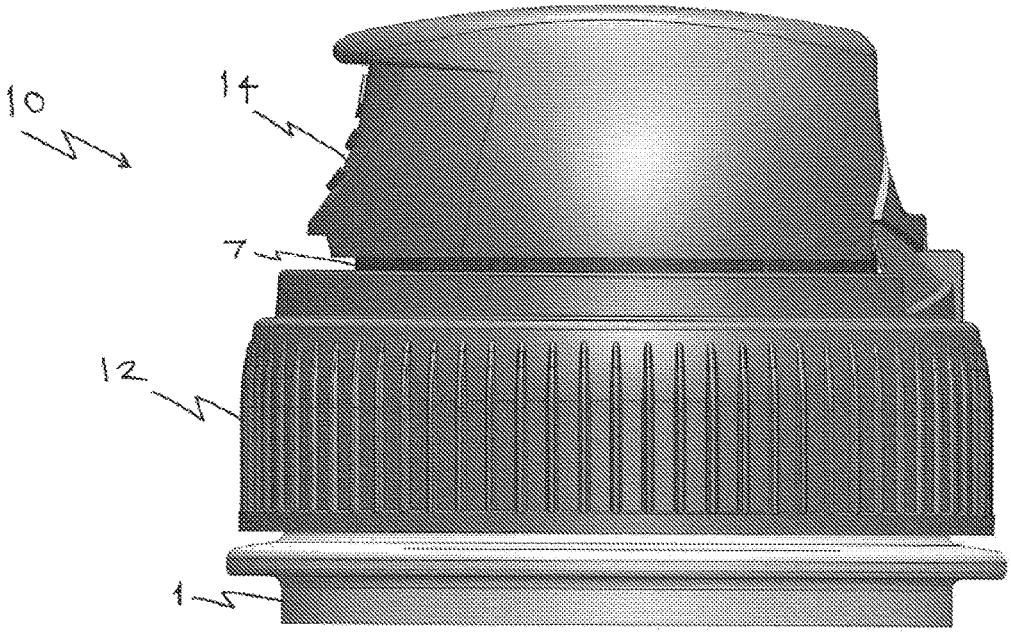
FIG. 8 and FIG. 9 are side and sectional views of the closure of FIG. 1 at the start of an alternative type of premier opening event in which a base is unscrewed.
Figure 9:
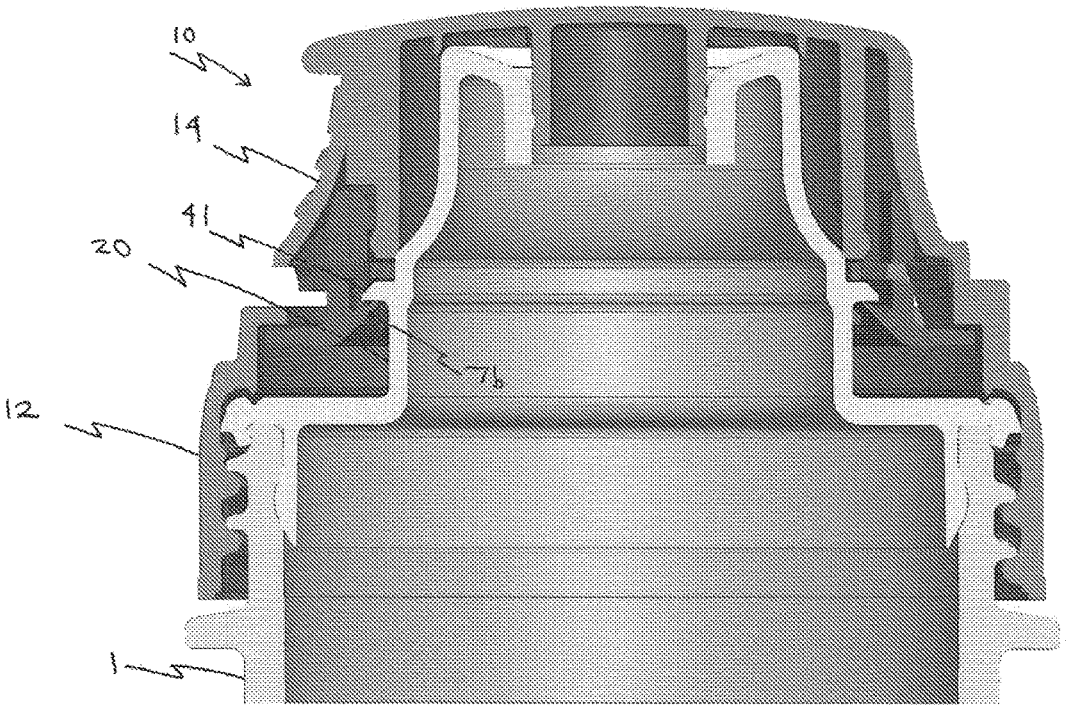

Initially as the base 12 is unscrewed the spout 20 remains on the neck. This means that as the base moves up the ring hook 7*b* contacts the underside of the spout flange 41 (FIG. 8 and FIG. 9).

Figure 10:
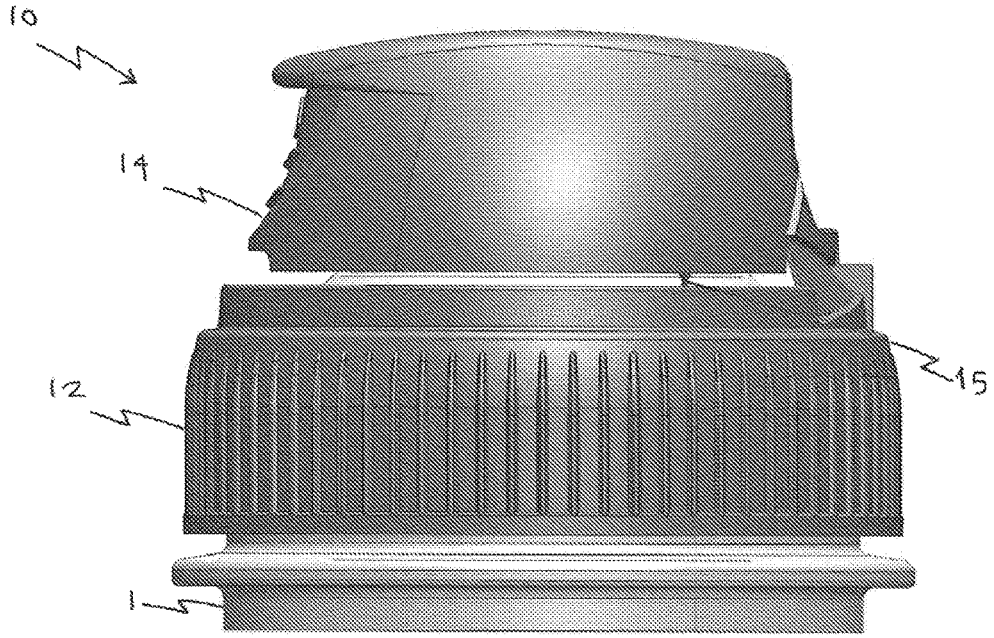
FIG. 10 and FIG. 11, FIG. 12 and FIG. 13, and FIG. 14 and FIG. 15, and FIG. 16 and FIG. 17 show side and sectional views as the base is progressively unscrewed.
Figure 11:
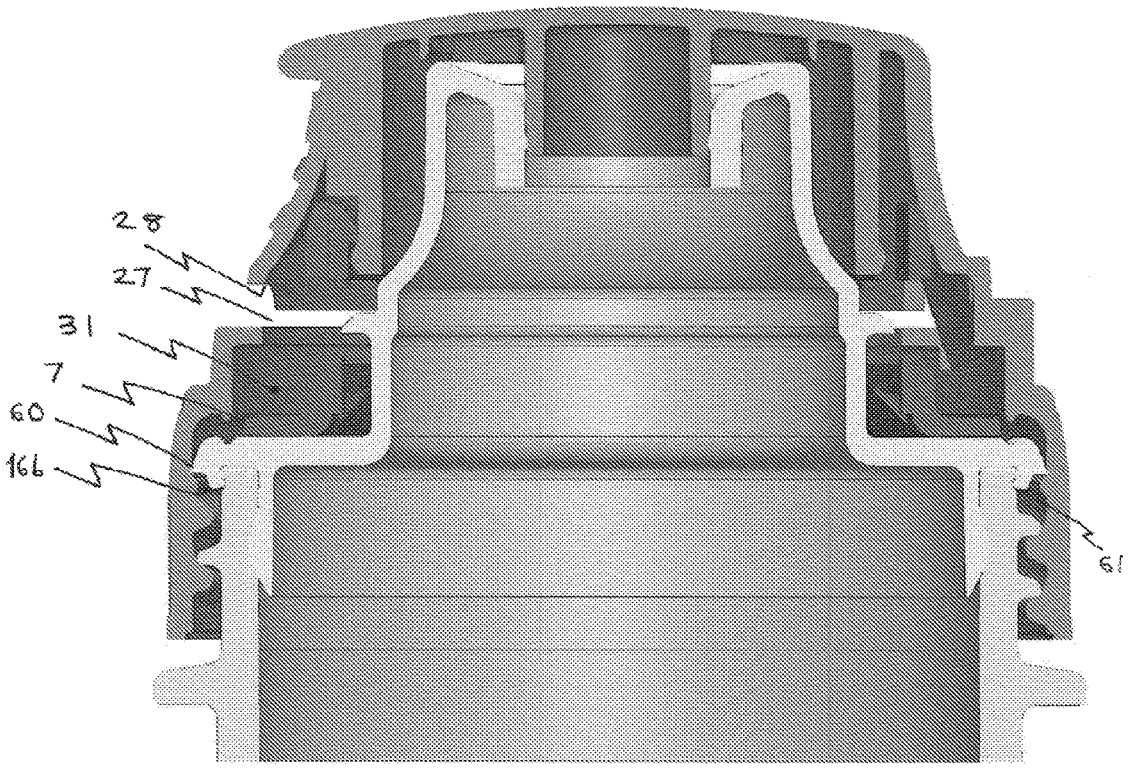
Figure 12:
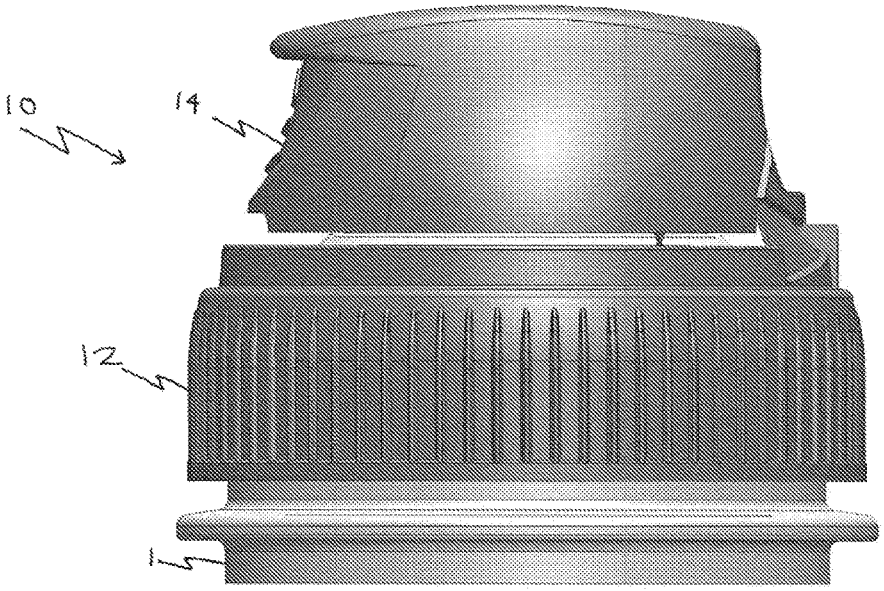
Figure 13:
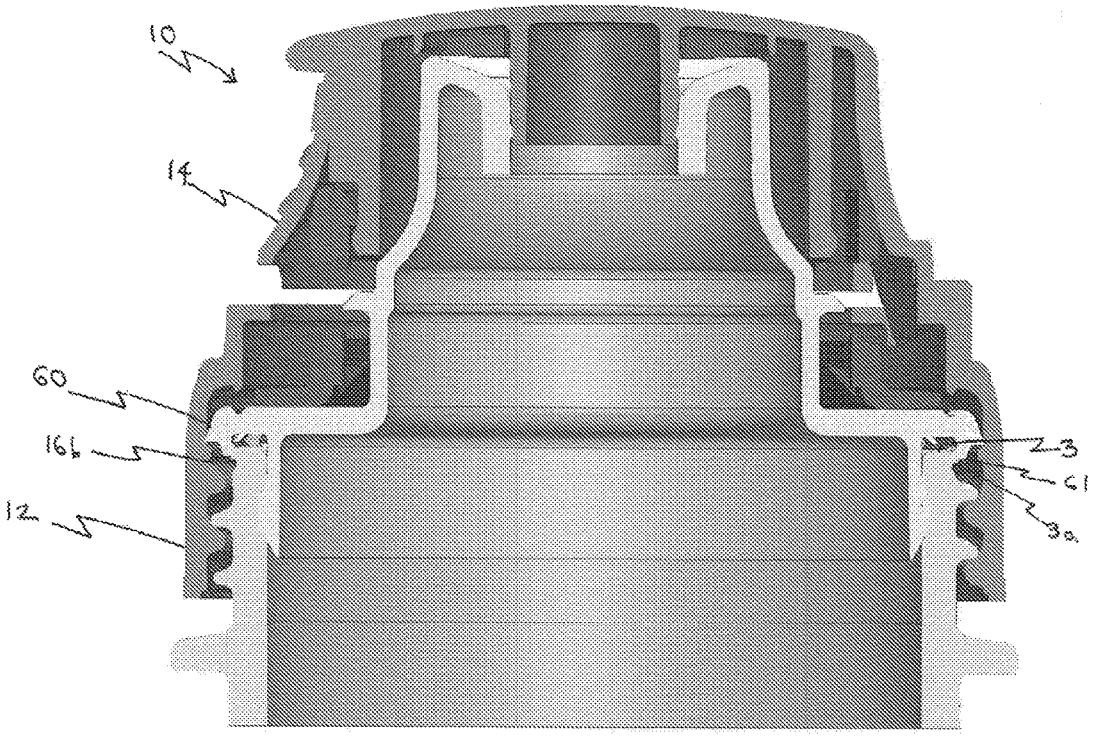
Figure 14:
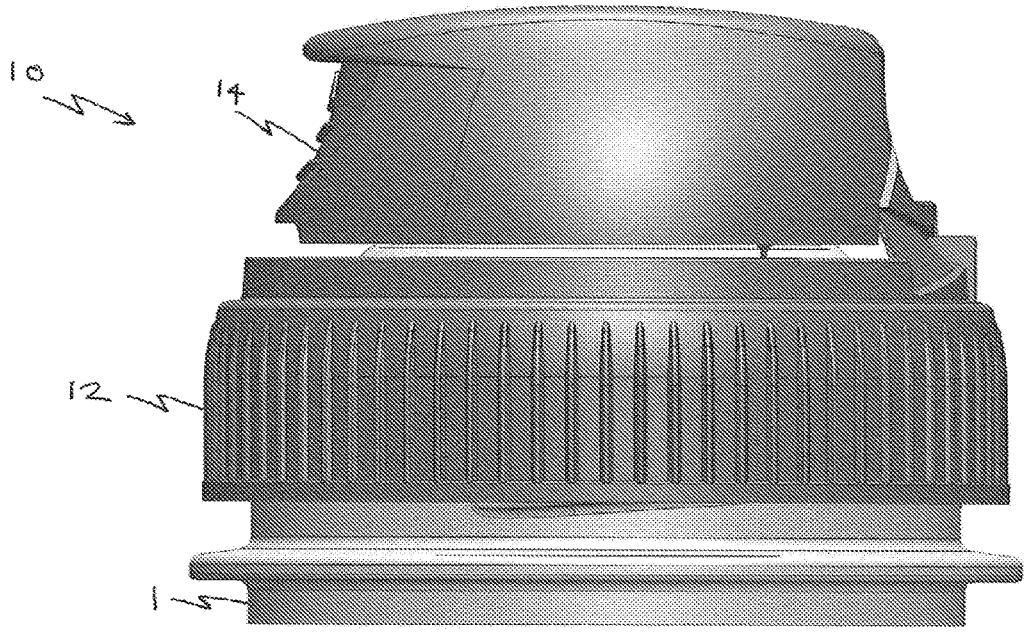
Figure 15:
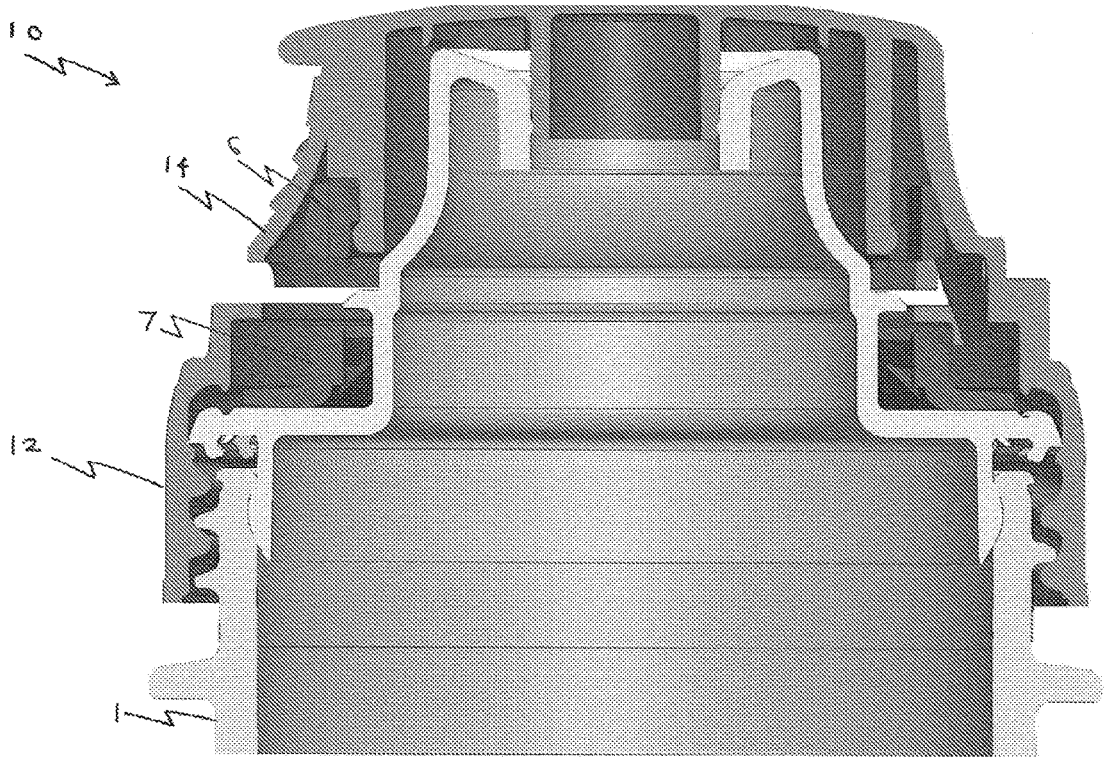
Figure 16:
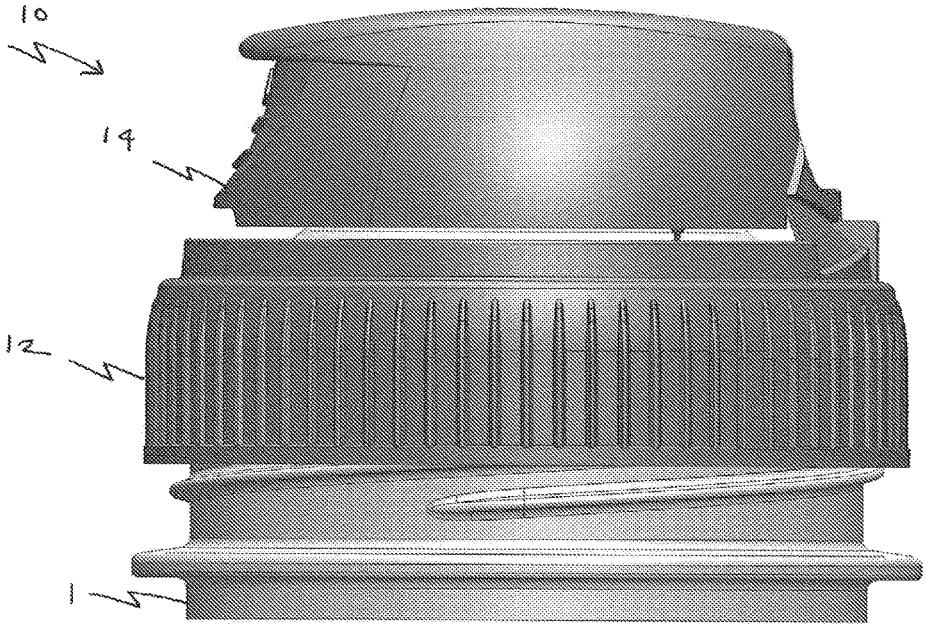
Figure 17:
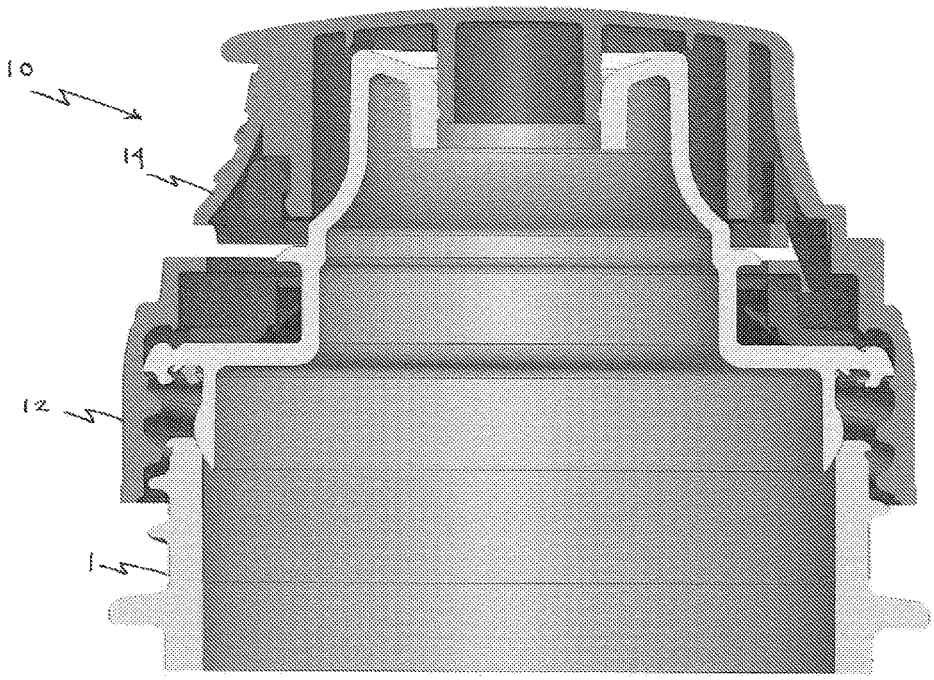

Continued unscrewing causes the ring to 7 to be broken away from the ring 6 (FIG. 10 and FIG. 11).

The ring 7 drops into the void 31 and can no longer be seen in the gap/window 27/28. It will also be noted that frangible bridges 15 between the base and lid are unbroken i.e. the member 5 has broken due to removal of the base from the neck.

Also in FIG. 10 and FIG. 11 it can be seen that because the base sidewall has moved up then bead 16*b* now abuts against the underside of the spokes 60. Up to this point the spout is retained on the neck by the interaction of the spoke bead 61 and the rim bead 3*a*.

As the base continues to be unscrewed the spout 20 now starts to be lifted off the neck rim (FIG. 12 and FIG. 13) by the bead 16*b*, but this is only after the member 5 has been broken (i.e., the delay in the lifting of the spout allows the member to be broken). The bead/claw 61 of the spout is pulled over the rim bead 3*a* by the interaction of the wall bead 16*b* and the spoke 60.

The base now continues to be unscrewed (FIG. 14 to FIG. 17) and may be completely removed.

Figure 18:
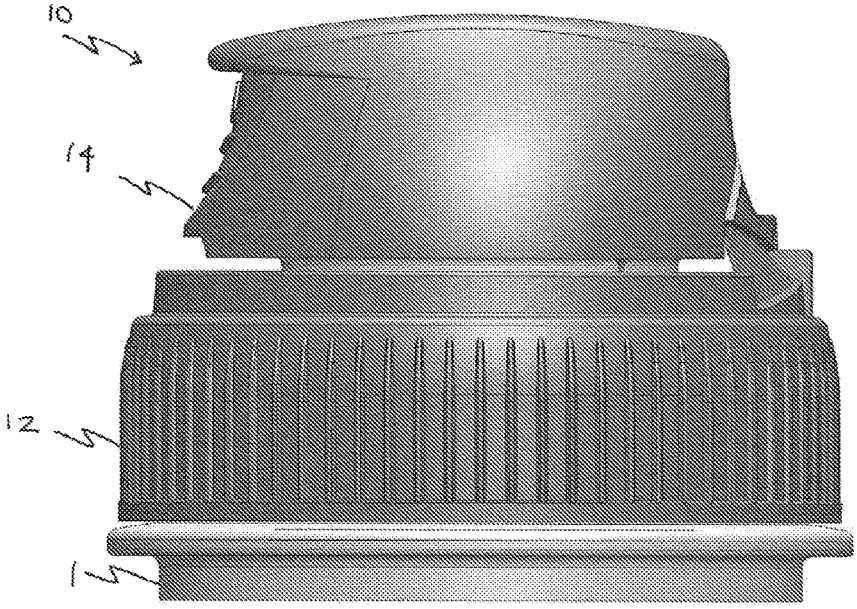
Figure 19:
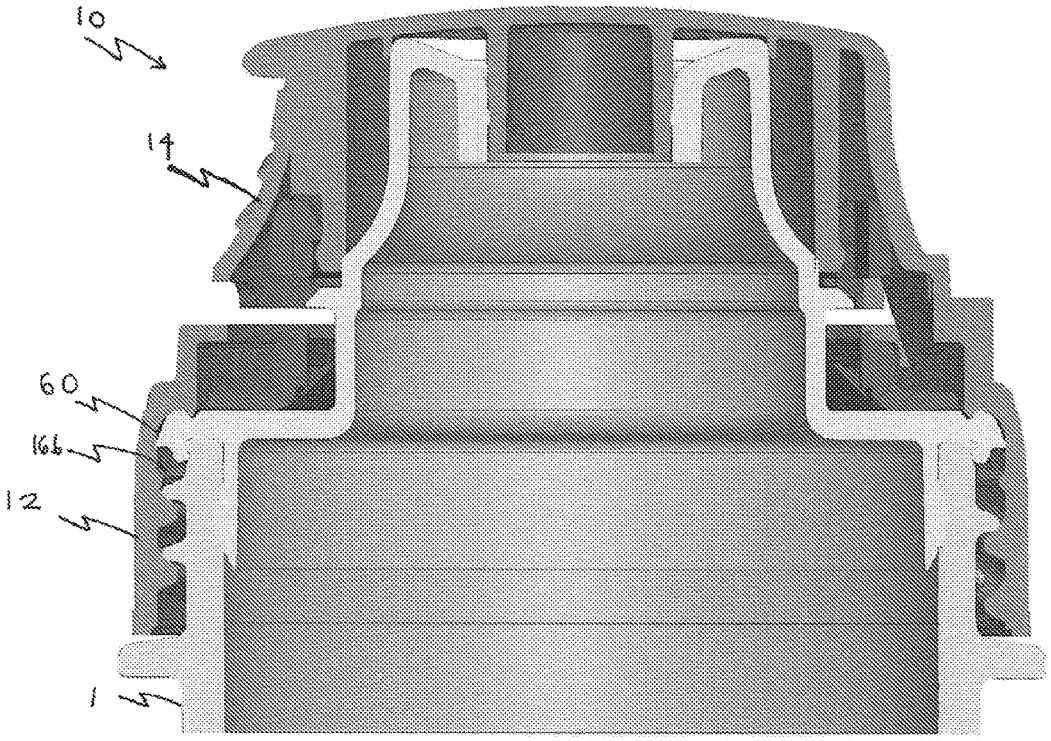

When the base is replaced (FIG. 18 and FIG. 19) the tamper-evidence remains as the breaking of the member 5 is an irreversible event.

The multi (in this embodiment double/dual) function of the member 5 removes the need for a separate tamper-evident band at the free end of the base sidewall and allows a reduction in weight of the closure and removes the need for a slitting step to form the band. By removing the need for a bead to cause breakage of a tamper band this also allow the weight of the neck finish to be reduced.

Figure 20:
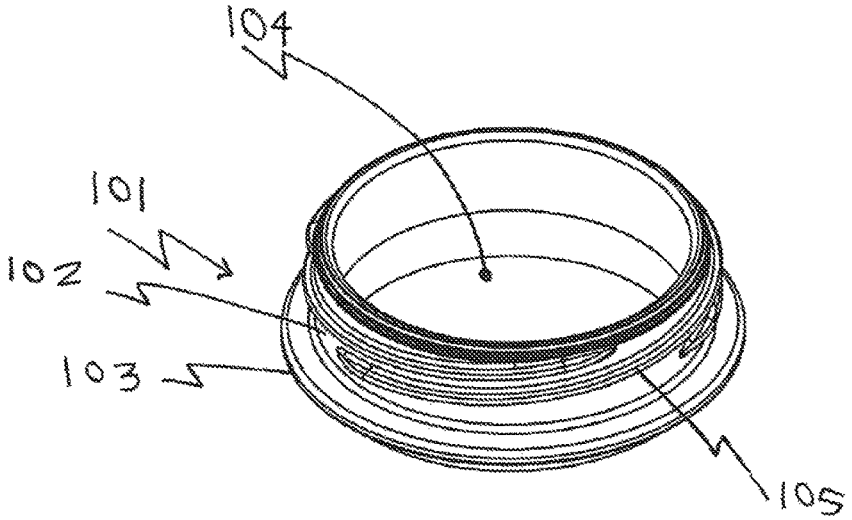
FIG. 20 is a perspective view of a container neck having a finish formed according to the present invention.
Figure 21:
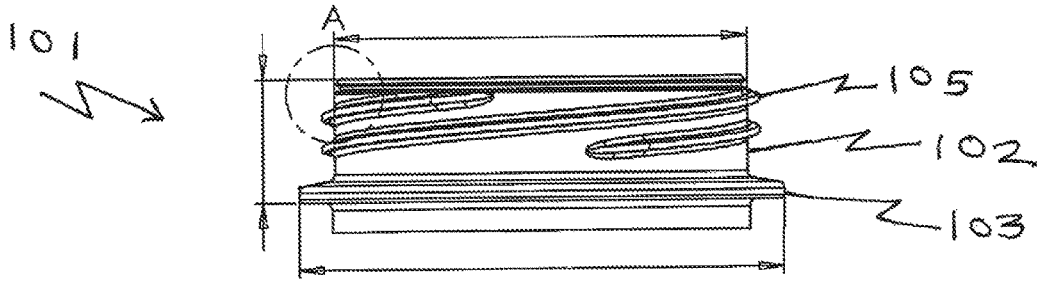
FIG. 21 is a side view of the neck of FIG. 20.
Figure 22:
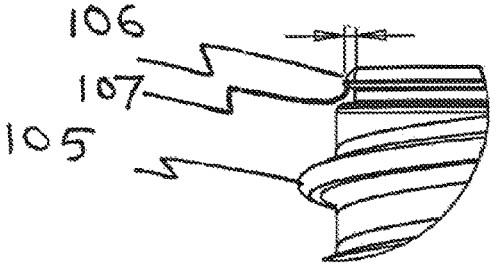
FIG. 22 is a magnified view of the part labelled A in FIG. 21.
Figure 23:
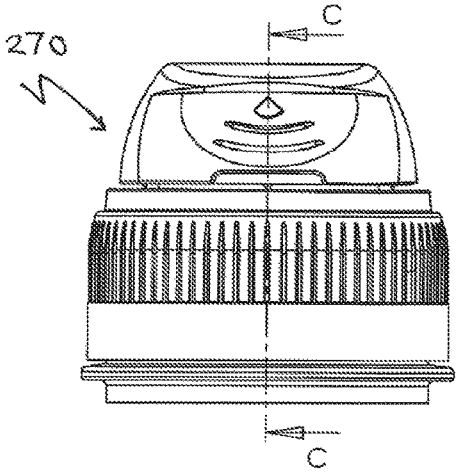
FIG. 23, FIG. 25, and FIG. 27 are front and side sectional views of a known container and closure and a side view of a known neck finish.
Figure 24:
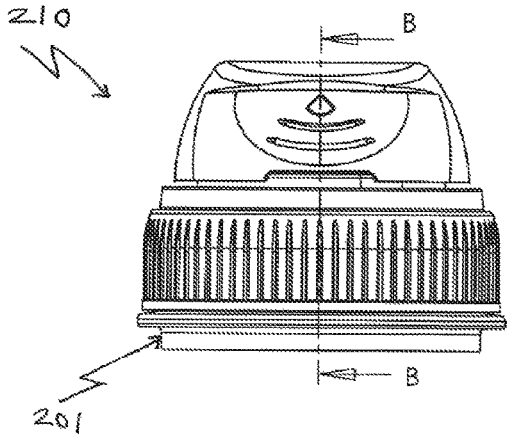
FIG. 24, FIG. 26, and FIG. 28 show views of a container and closure formed according to the present invention and corresponding to FIG. 23, FIG. 25, and FIG. 27, respectively.
Figure 25:
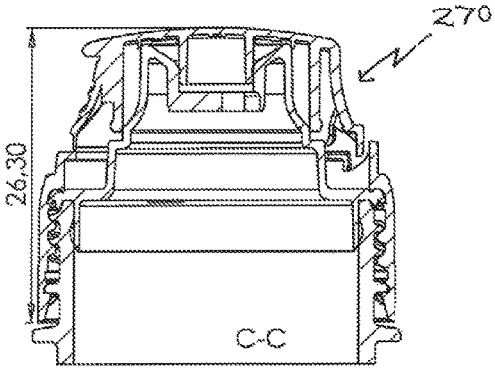
Figure 26:
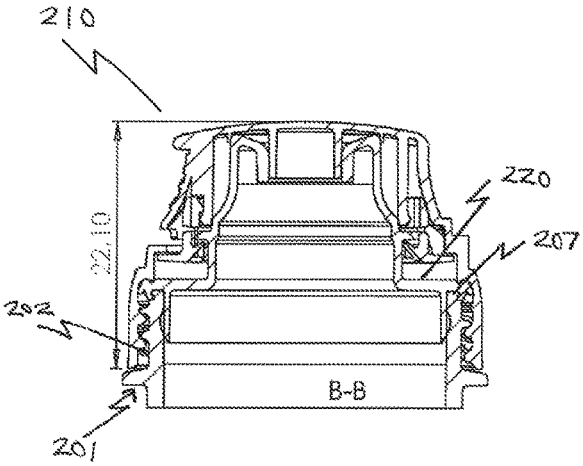
Figure 27:
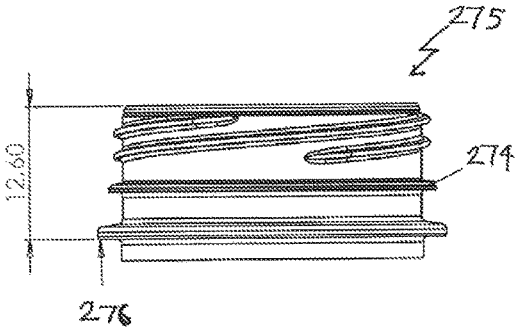
Figure 28:
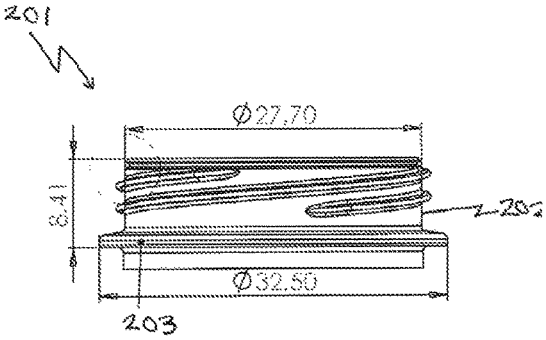

Referring now to FIG. 20 to FIG. 22 there is shown a container neck 101 formed according to an aspect of the present invention.

The neck 101 includes a neck finish 102 and a transfer bead 103.

The finish 102 is the part of the container that holds a cap or closure in use, and surrounds the opening 104 in the container. It is so named because, in early hand glass manufacturing, it was the last part of the glass container to be made, hence the term "finish".

The exterior of the finish 102 includes a single start screw thread 105. In this embodiment this is a continuous spiral projecting ridge on the finish intended to mesh with the thread of a screw-type closure. Other screw thread formations, including multi-start threads, are possible.

The transfer bead 103 is a continuous horizontal ridge near the bottom of the finish used in transferring of a container from one part of a manufacturing operation to another.

It will be noted that the neck finish rim 106 includes an undercut 107 the purpose of which is described in more detail below.

In this embodiment dimension x is in the range 25 mm to 30 mm (for example 27.70 mm), dimension y is in the range 30 mm to 35 mm (for example 32.50 mm), dimension z is in the range 7 mm to 11 mm (for example 8.41 mm) and dimension $\alpha$ is in the range 0.2 mm to 0.3 mm (for example 0.25 mm). All dimensions are within certain tolerances, for example ±10%.

FIG. 23 to FIG. 28 show a comparison of a known closure and neck finish with a closure and neck finish formed in accordance with aspects of the present invention.

The known closure 270 includes a tamper-evident band 271 at the free end of its sidewall 272. The band 271 includes a bead 273 that engages under a tamper band bead 274 necessarily formed on the neck finish 275 in addition to a transfer bead 276.

By contrast, the closure 210 does not have a tamper-evident band and accordingly the neck finish does not require a tamper band bead. This means that not only can the weight of the closure be significantly reduced, but the weight of the finish, formed without a tamper band bead, can also be significantly reduced.

It will be seen that the closure spout 220 is clipped under the neck finish undercut 207. The closure 210 operates in accordance with the principles set out in relation to FIG. 1 to FIG. 19. In this embodiment the provision of a dual function tamper system in the closure produces a height reduction of approximately 4.19 mm over a corresponding tamper band closure. The short neck finish 202 gives a significant weight saving.

Some aspects and embodiments of the present invention consist of a closure and/or neck finish substantially exactly as shown in FIG. 23 to FIG. 28, i.e., restricted to the dimensions shown in the drawings (within a tolerance of ±10%).

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention as defined by the appended claims and their equivalents.

The invention claimed is:

1. A flip-top dispensing closure comprising a base connectable to a container neck; and a lid hingedly connected to the base so as to be movable between a closed position and an open position;

the closure further comprising a tamper-indicating member, in which the tamper-indicating member is activated either: upon a first opening of the lid, or if the base is removed from the neck;

wherein an irreversible tamper-evident break occurs if the first opening of the lid is the premier opening event and, alternatively, the irreversible tamper-evident break occurs if the removing the base from the neck is the premier opening event, wherein the closure further comprises a dispensing member, and wherein the closure is configured such when the base is removed from the neck the dispensing member is retained on the neck until after the tamper-indicating member is activated, and thereafter is removed together with the base.

2. The flip-top dispenser closure of claim 1, wherein the dispensing member includes a first element that interacts with a corresponding second element on the tamper-indicating member, the elements configured to interact and thereby activate the tamper-indicating member upon opening the lid or removing the base.

3. The flip-top dispenser closure of claim 2, wherein the dispensing member first element is a bead or flange.

4. The flip-top dispenser closure of claim 1, wherein the dispensing member comprises a spoke bead for retaining it on the container neck.

5. The flip-top dispenser closure of claim 4, wherein the spoke bead is a claw.

6. The flip-top dispenser closure of claim 1, wherein the base includes an annular retention bead or a wall bead for engaging the dispensing member.

7. The flip-top dispenser closure of claim 6, wherein the annular retention bead or wall bead is located axially spaced from the dispensing member so that as the base initially moves axially off the neck the dispensing member remains on the neck, thereby causing activation of the tamper-indicating member.

8. The flip-top dispenser closure of claim 1, wherein the dispensing member causes the tamper-indicating member to break if the base is removed from the neck.

9. The flip-top dispenser closure of claim 1, wherein the tamper-indicating member comprises a double ring structure with two rings frangibly connected together.

10. The flip-top dispenser closure of claim 1, wherein the base includes a pocket or void, and wherein when the tamper-indicating member is activated at least part of the member falls into the pocket or void.

11. The flip-top dispenser closure of claim 1 in combination with a container.

12. A flip-top dispenser closure comprising a base connectable to a container neck; and a lid hingedly connected to the base so as to be movable between a closed position and an open position;

the closure further comprising a tamper-indicating member, in which the tamper-indicating member is activated either: upon a first opening of the lid; or if the base is removed from the neck;

wherein an irreversible tamper-evident break event occurs if first opening of the lid is the premier opening event and alternatively the said irreversible tamper-evident break event occurs if removing the base from the neck is the premier opening event, wherein the closure further comprises a dispensing member, and wherein the base includes a base bead for engaging the dispensing member so as to lift the dispensing member off the neck if the base is removed.

13. A flip-top dispenser closure comprising a base connectable to a container neck; and a lid hingedly connected to the base so as to be movable between a closed position and an open position;

the closure further comprising a tamper-indicating member, in which the tamper-indicating member is activated either: upon a first opening of the lid; or if the base is removed from the neck;

wherein an irreversible tamper-evident break event occurs if first opening of the lid is the premier opening event and alternatively the said irreversible tamper-evident break event occurs if removing the base from the neck is the premier opening event, wherein the closure further comprises a dispensing member, wherein the base includes a pocket or void, and wherein when the tamper-indicating member is activated at least part of the member falls into the pocket or void.

14. A flip-top dispenser closure comprising a base connectable to a container neck; and a lid hingedly connected to the base so as to be movable between a closed position and an open position;

the closure further comprising a tamper-indicating member, in which the tamper-indicating member is activated either: upon a first opening of the lid; or if the base is removed from the neck;

wherein an irreversible tamper-evident break event occurs if first opening of the lid is the premier opening event and alternatively the said irreversible tamper-evident break event occurs if removing the base from the neck is the premier opening event, wherein the closure further comprises a dispensing member, wherein the tamper-indicating member is a separate element and comprises a double ring structure with two rings frangibly connected together, and wherein when the tamper-indicating member is activated the two rings are separated.

15. A flip-top dispenser closure as claimed in claim 14, wherein the tamper-indicating member fits between the base and the lid, and fits radially outward of the dispensing member.

* * * * *